United States Patent [19]

Lipfert

[11] 4,033,567

[45] * July 5, 1977

[54] CUSHIONING MATERIAL CONSTRUCTION

[75] Inventor: Donald Ernest Lipfert, Woolwich, Maine

[73] Assignee: Deres Development Corporation, Greenwich, Conn.

[ * ] Notice: The portion of the term of this patent subsequent to Feb. 5, 1991, has been disclaimed.

[22] Filed: Apr. 2, 1973

[21] Appl. No.: 347,069

Related U.S. Application Data

[63] Continuation-in-part of Ser. No. 75,373, Sept. 25, 1970, Pat. No. 3,790,150.

[30] Foreign Application Priority Data

Oct. 4, 1969 United Kingdom ..... 48860/69

[52] U.S. Cl. ..... 267/151; 5/351; 297/452; 297/458; 297/455; 128/70

[51] Int. Cl.[2] ..... A47C 25/02

[58] Field of Search ..... 267/80, 102, 103, 85, 267/142, 151; 5/351; 297/452, 458, 455; 305/6; 128/70

[56] References Cited

UNITED STATES PATENTS 3,790,150 2/1974 Lippert ..... 267/151

*Primary Examiner*—James B. Marbert
*Attorney, Agent, or Firm*—Edward Halle

[57] ABSTRACT

A cushioning material system or construction having at least one module comprising balanced levers and displaceable bearing means.

43 Claims, 30 Drawing Figures

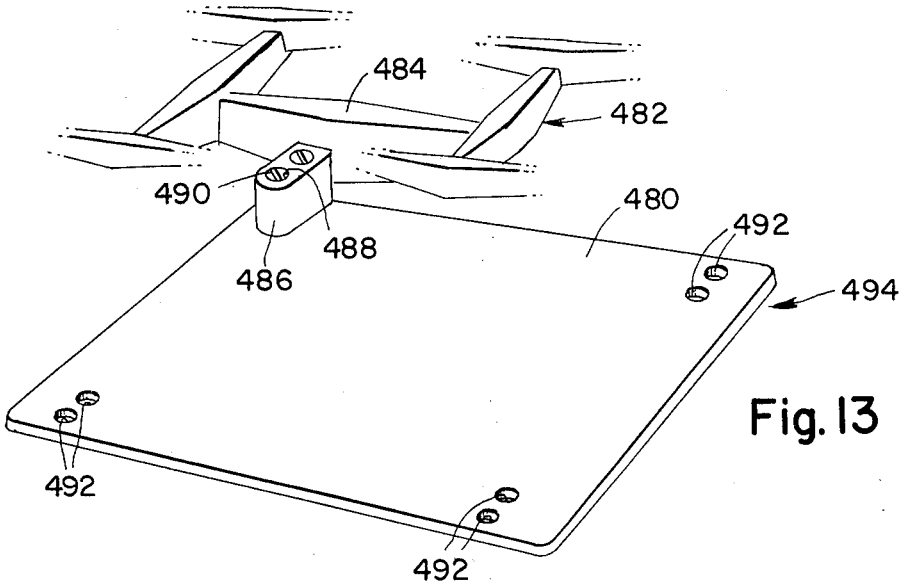
Fig. 13
Fig. 14
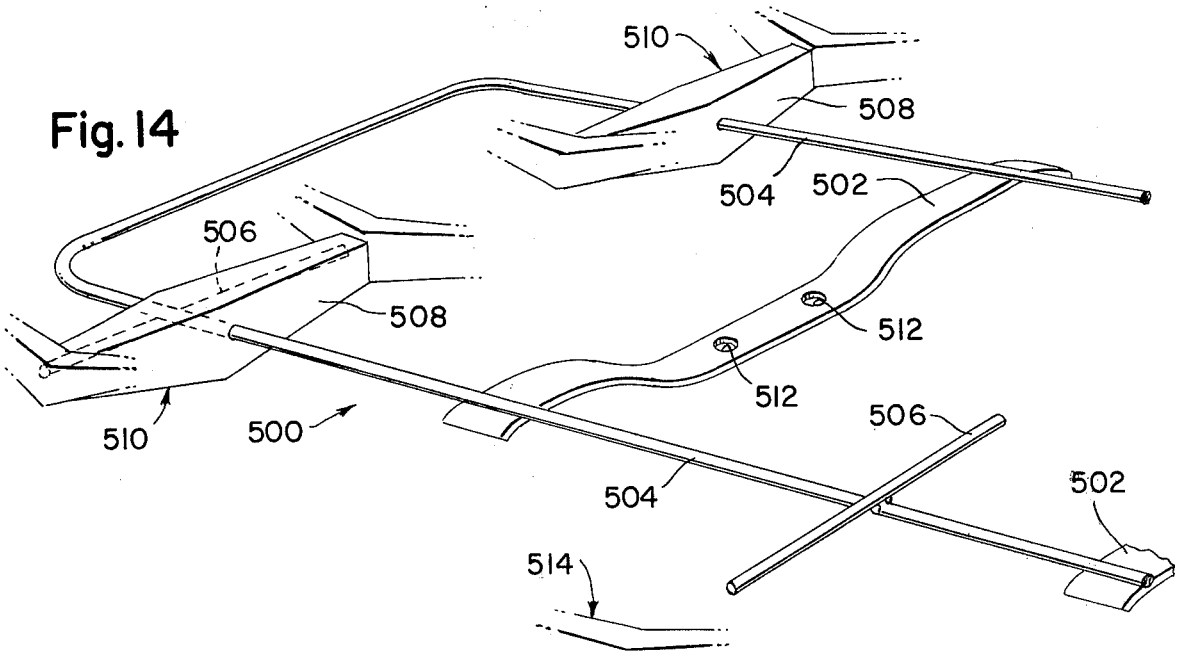
Fig. 15
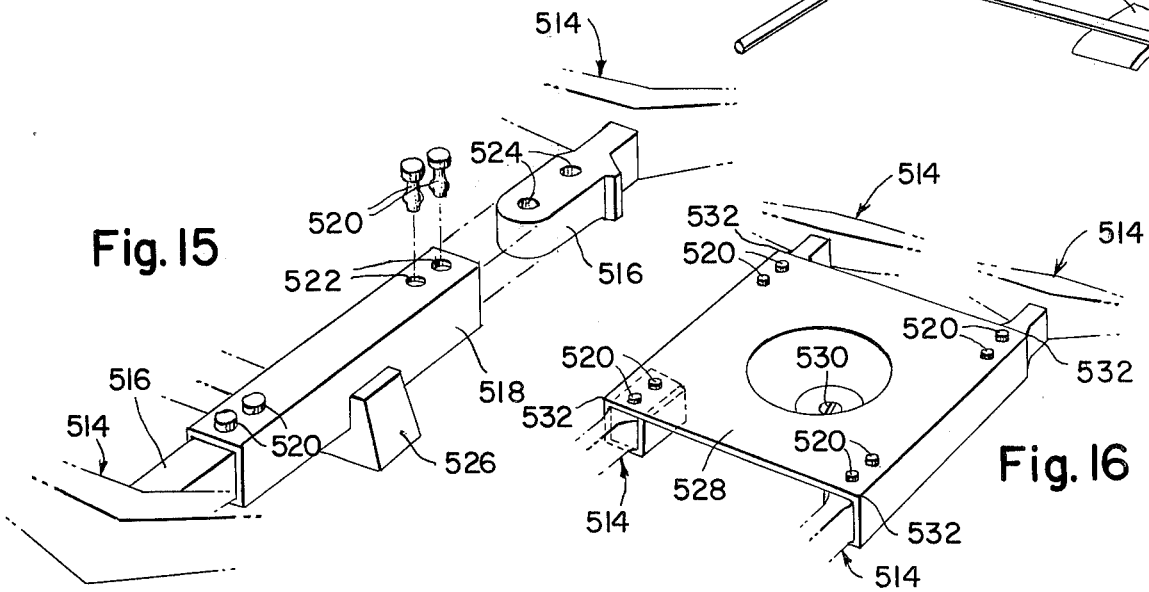
Fig. 16

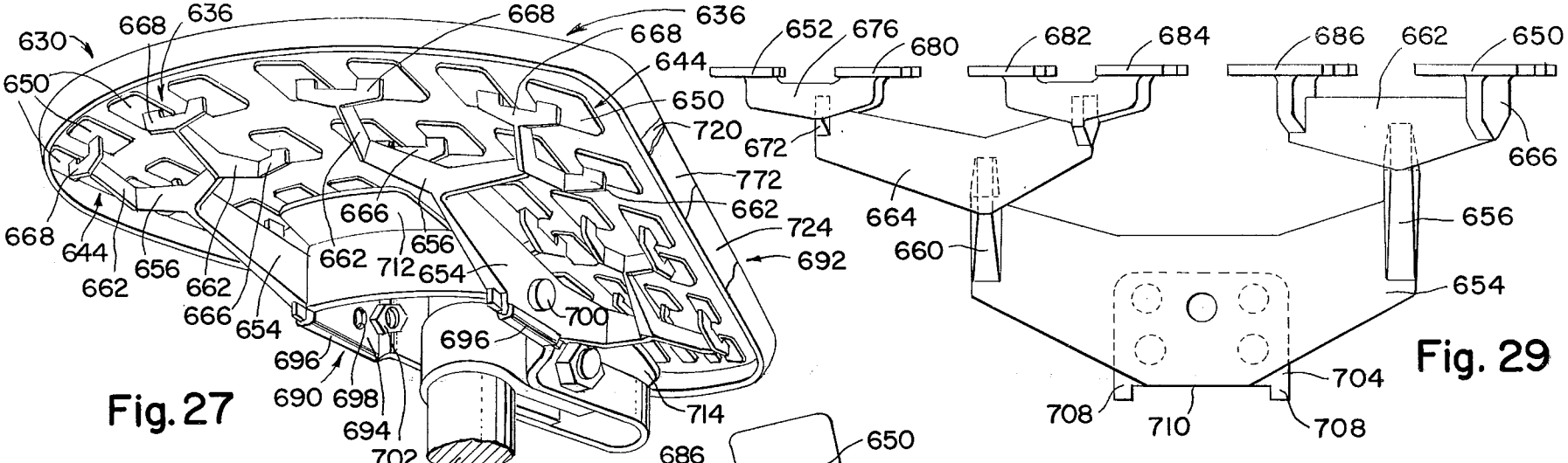
Fig. 29
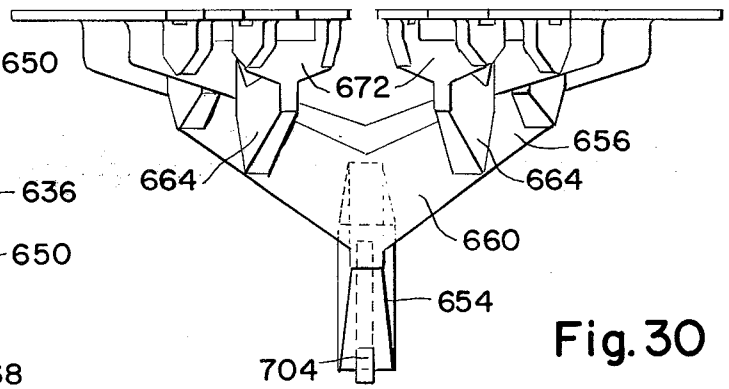
Fig. 30
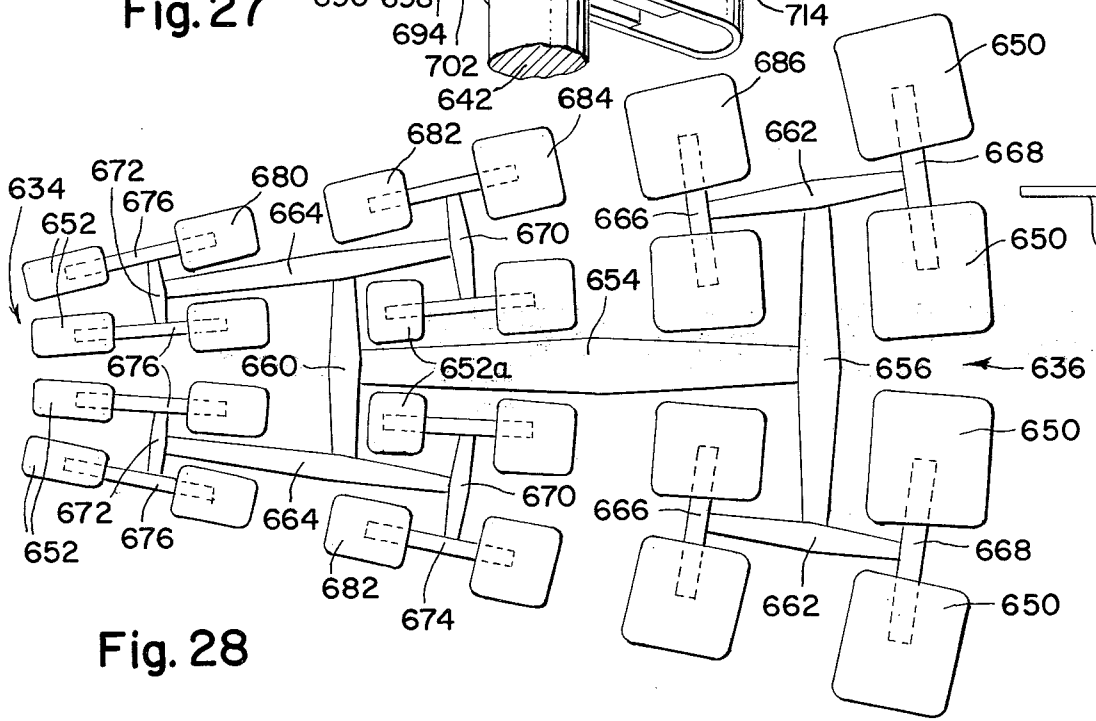
Fig. 27
Fig. 28

CUSHIONING MATERIAL CONSTRUCTION

CROSS REFERENCE TO RELATED APPLICATION

This application is a continuation-in-part of co-pending U.S. patent application of Donald Ernest Lipfert for MECHANICAL SUPPORT SYSTEM, Ser. No. 75,373, filed Sept. 25, 1970, now U.S. Pat. No. 3,790,150, dated Feb. 5, 1974, the entire disclosure of which is incorporated herein by reference.

BACKGROUND OF THE INVENTION

The cushioning material construction of the invention, although it may take several forms as described hereinbelow, is basically a construction comprising one or more modules, each having a grouping of displaceable bearing means in a system of inter-connected levers wherein displacement of one displaceable bearing means in one direction will displace another displaceable bearing means in another direction, with one or more of said modules being mounted on frame or base means in a manner to utilize the cushioning effect of the construction for various purposes. The term "displaceable bearing means" as used herein is synonymous with the term "displaceable load support means" as used in U.S. Pat. No. 3,790,150 it being understood that such bearing means may support a load or bear against a load or be a part of a system which supports a load against a surface or surfaces, or to generally bear against anything to distribute forces through the module comprising the lever system and the displaceable bearing means.

For example, it may be used as a shock absorbing means in various constructions such as walls, stationary buildings, elevators, or vehicles, or the like, when things or personnel fall or are otherwise forced against a surface, to prevent or minimize damage or injury.

It is, therefore, an object of the present invention to provide a module with cushioning qualities for various forms of constructions such as mattresses, seats, sofas, bicycle seats, shoes, cushions, buildings, vehicles, packaging materials and wheels, and other items which may utilize such a module cushioning construction of the invention. It is a further object of the invention to provide material constructions which can be combined with the various mentioned articles to provide combinations which will include the cushioning features of the invention. Various other objects and advantages will appear from the specification hereinbelow.

BRIEF DESCRIPTION OF THE INVENTION

The basis module cushioning concept has been disclosed in U.S. Pat. No. 3,790,150. The improvements set forth herein include improvements in the module as well as its adaptation to a wide range of consructions such as an improved mattress, an improved gatching mattress, chairs, sofas, seats, seat backs, motorcycle, bicycle and stool seats and cushioning materials in general.

As originally conceived and constructed, the module system works very well at distributing supporting pressures over irregularly shaped bodies. The basic reason for this is the two modes operative to provide support. The torsional mode allows initial rotation of the levers to readily conform to the shape of the load. The flexural mode provides the stiffness necessary to support the load. The torsional spring constant may be very soft and the flexural spring constant relatively stiff. A tapered lever design greatly increased the spread possible between torsional and flexural spring constants. The tapered shape also reduces the amount of material necessary for any given design by more nearly approaching uniform stress in each lever, also effecting a cost saving.

DESCRIPTION OF THE DRAWINGS

U.S. Pat. No. 3,790,150 contains drawings numbered FIGS. 1 through 25. The invention is further illustrated in the accompanying drawings in which:

FIG. 13 is a perspective view;

FIG. 14 is a perspective view with parts cut away;

FIG. 15 is a perspective view with parts cut away;

FIG. 16 is a perspective view with parts cut away;

FIG. 27 is a perspective view;

FIG. 28 is a top plan view;

FIG. 29 is a side elevation; and

FIG. 30 is an end elevation.

DETAILED DESCRIPTION OF THE INVENTION

Figure 1:
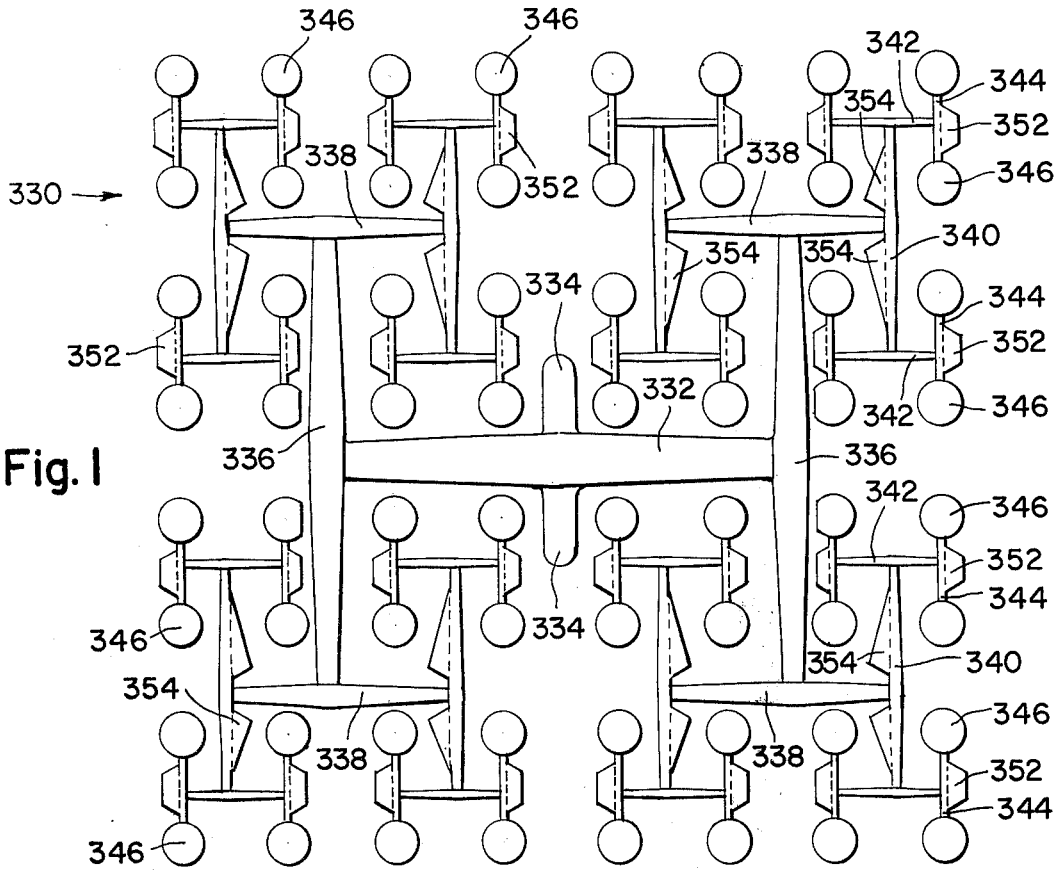
FIG. 1 is a top plan view of a module of the invention enlarged with relation to FIGS. 4, 5 and 7 described below.

A basic module of the invention has been illustrated in U.S. Pat. No. 3,790,150 at FIG. 1 (reference numeral 22), FIG. 5 and FIG. 6, and described therein.

Figure 2:
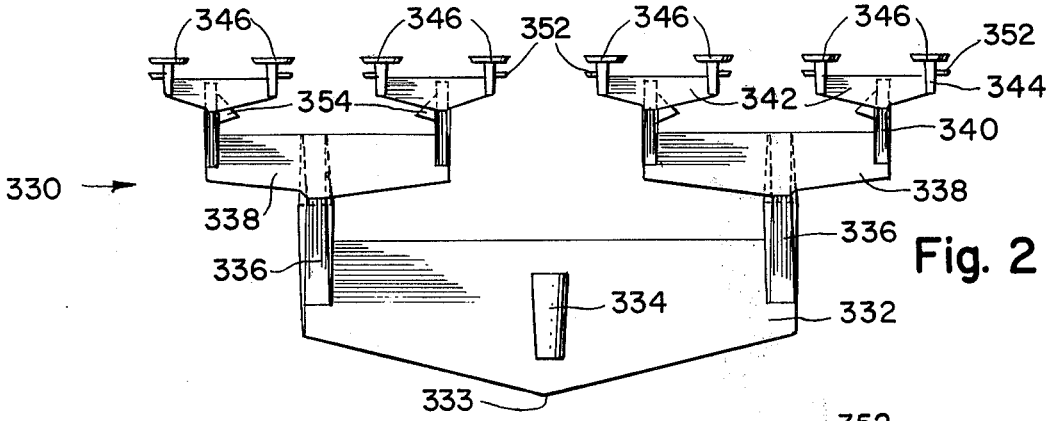
FIG. 2 is a side elevation of the module shown in FIG. 1.
Figure 3:
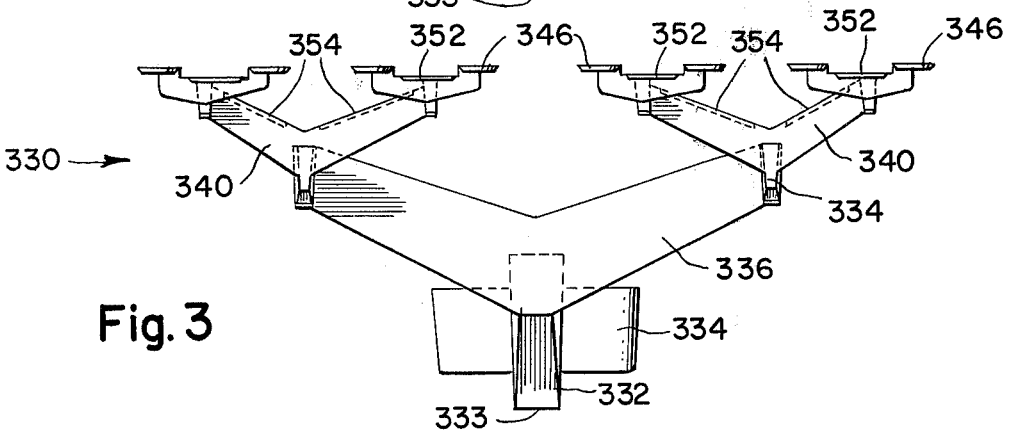
FIG. 3 is an end elevation of the module shown in FIG. 1.

An improved module with some modification is shown herein in FIGS. 1, 2 and 3 as module 330. Module 330 has a lower lever 332 having a pair of laterally extending torsion mounting lugs 334. Lever 332 is connected at each of its end to central portions of levers 336 which, in turn, are connected at ends to levers 338 which, in turn, are connected at ends to levers 340, thence to levers 342, thence to levers 344 which, in turn, have displaceable bearing means 346 at their ends.

The particular construction of the module is in accordance with that disclosed in U.S. Pat. No. 3,790,150. However, there are some improvements disclosed in FIGS. 1, 2 and 3 herein which enhance the function and construction of the basic module of the invention. For example, the mounting lugs 334 may provide a standardized and positive means for mounting the modules 330 to various types of the construction, as will appear herein. The branched levers 332–344, inclusive, are shown with a taper from center toward end which maximizes the differential between their torsional and flexural stiffness to improve these qualities while minimizing the amount of material needed per module.

In module 330 the uppermost levers 344 are provided with displaceable bearing means 346 which extend above the levers 344. These first mentioned displaceable bearing means may be termed primary displaceable bearing means. They are shown in FIGS. 1–3 of the drawings as circular pads. However, they may be of any particular shape or configuration desirable for the intended end use. If the module 330 is to be used in connection with a mattress, a layer of sheet foam 348, as shown in FIG. 6, may be fastened or cemented over the primary bearing pads 346 or laminated to a knit fabric that is cemented to the primary bearing pads (see FIG. 5) to provide a continuous displaceable surface such as foam surface 350.

Secondary bearings 352, as shown in FIGS. 1, 2 and 3 in the form of plates or pads may be placed on the upper portion of levers 344 on a plane somewhat lower than the plane of the first mentioned primary bearing means 346 and tertiary bearings 354 may similarly be placed along upper portions of levers 340. In such a design the stiffness of the module 330 increases as the load increases and the foam sheet 348 contacts first the secondary 352 and then the tertiary bearings 354. The primary bearing pads 346, as well as the secondary and tertiary bearing pads 352 and 354, are preferably made as large as possible within the construction to provide a maximum bearing area.

These additional load support surfaces make it possible to design for low pressures for a person lying and yet support substantially higher pressures for a person sitting.

Figures 4, 5, 6, 7:
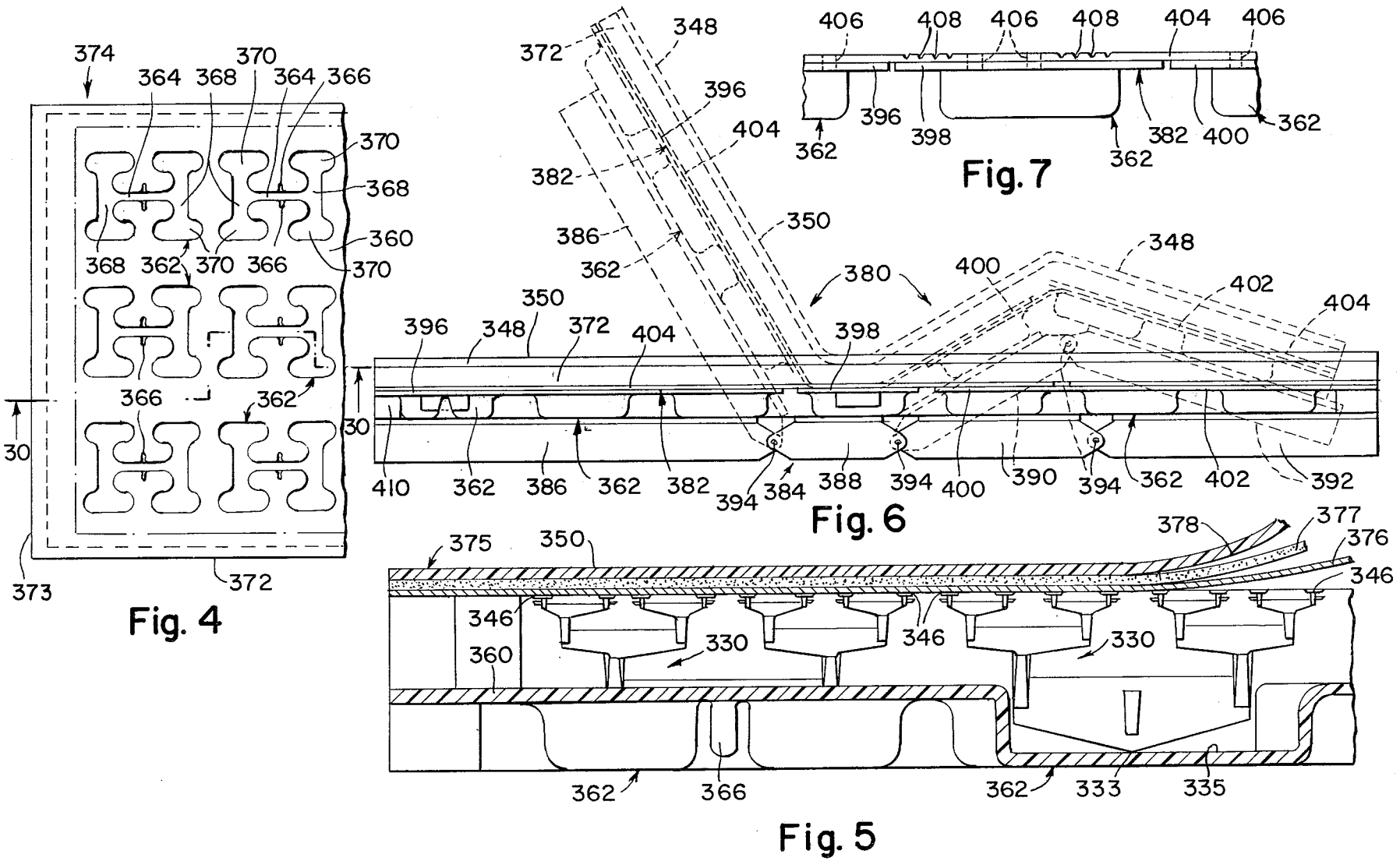
FIG. 4 is a top plan view with parts cut away.
FIG. 5 is a sectional view along lines 5—5 of FIG. 4.
FIG. 6 is a side elevation of another mattress of the invention with parts in phantom showing two different positions.
FIG. 7 is an enlarged detail of a portion of FIG. 6.

In a preferred form of load support cushioning construction which is adaptable for use in many forms of the invention, one or more modules 330 are combined with a base 360, as shown in FIGS. 4 and 5 of the drawings. The base 360 is made of a formed semi-rigid material such as A. B. S. (acrylonitrile butadiene styrene), or any other suitable material, in which at least one well, such as H shaped recess 362, is formed. The cross line recess 364 of the well 362 is adapted to receive lever 332 of module 330 and is provided with lug receiving journals 366 for the mounting lugs 334. The side recesses 368 of the H shaped wells 362 are adapted to receive levers 336, and recesses 370 provide space for levers 338 to be displaced downwardly. While one H shaped well 362 has been described, reference to FIG. 4 shows that there may be a plurality placed in formation so that a plurality of modules 330 will present a fairly regular bearing surface at its outermost surface in a plane comprising or including groupings of primary bearings 346, as shown in FIG. 5.

Base 360 can be finished off with an edging 372 of foam or any other flexible finishing material and a covering such as foam sheet 348 may be spread and affixed over the entire construction. This construction can be made in various sizes to be used as mattresses, seat covers, seat backs and seats.

The mounting lugs 334 may be dropped in the recessed journals 366 and held in place by fit and/or force of gravity, or they may be clipped in by shaping the journals, by steel clips not shown, by cementing, heat deforming, or any other means known to the art.

Recesses 364, 368 and 370 are wide enough to permit levers 332, 336 and 338 to move freely within the scope of their movements.

Lowest lever 332 has a pivoting means such as corner 333 so that the entire module 330, as seen in FIG. 6, may rock from side to side on floor 335 of well 362 within the limits of the stiffness of the module material as controlled by torsion mounting lugs 334 within the journals 366, and by the internal size of the well 362.

It has been found that a mattress having 21 modules 330, each approximately 10 inches square, spaced and arranged in 3 rows or 7, will make a suitable mattress 374 including the foam edging 372 and 373 for a single bed approximately 76 inches long and 35 inches wide. The first two wells 362 of the three rows are shown in the portion of mattress 374 shown in FIG. 4.

When making a seat cushion smaller modules may be used and the tertiary 354 and even the secondary 352 bearings may be eliminated, relying mainly on the displaceable bearing means 346 to make up the contacting surface for the load.

Reference is now made to FIG. 5 of the drawings in which an alternate form of composite mattress cover 375 is shown. Mattress cover 375 has a lower layer of a knit fabric 376, an intermediate layer of a relatively stiff foam 377 and an upper layer of a softer foam 378. The three layers are laminated together and are fastened or cemented to the primary bearing surfaces 346 in the same manner as the single layer of foam 148. The purpose of the laminated layers as illustrated in FIG. 6 is to provide a covering which will act to provide the necessary stiffness for the weight of a sitting person and also the necessary surface softness for a person who is lying out full length. The principal characteristic of covering 375 is comprised in the stiffer foam 377 and knit fabric 376 which are capable of distributing higher pressures so that a sitting person will not press a soft foam single layer against the bearing surfaces 346 to the extent that the impression of the bearing surfaces 346 will be felt through the foam.

In FIG. 6 a mattress 380 having an articulated base 382 adapted to move with the upper torso and legs of a patient is shown. Module mounting means such as wells 362 are arranged on the various parts of the mattress base 382 to provide a surface 350 in accordance with the invention adapted for adjustment for hospital use. FIG. 6 is in side elevation and it is to be understood that each well 362 shown is one of three wells 362 in side by side relationship as shown in FIG. 4. The mattress base 382 is arranged over a bed frame 384 which comprises bed frame sections 386, 388, 390 and 392 which are articulated on pivoting points 394 in a manner well known to the art to operate the articulated sectioning of the mattress 380.

A group of 12 wells 362 form the head portion 396 of the base 382. Portion 396 is adapted to lie over bed frame section 386 and may be moved upwardly from a horizontal position, as shown in solid line in FIG. 6, to an angular position as shown in dotted line. A central portion 398 comprises a group of three wells 362 side by side in mattress portion 398 and lies over bed frame section 388. Third and fourth groups of wells 362 adapted to underlie the legs of a patient are comprised in movable portions 400 and 402 of mattress base 382. Portions 400 and 402 are designed to lie on a horizontal plane over bed frame portions 390 and 392 (as shown in solid line) and to be moved upwardly in a gatching relationship as shown in dotted line in FIG. 7.

The various base portions 396, 398, 400 and 402 are held together by a pair of flexible strips 404, preferably made of a durable plastic material. The strips 404 form runner means which are fixed to the base portions 396, 398, 400 and 402 by means of the fasteners 406. Thus the strips 404 hold the sections of the entire base 382 together.

The strips 406 are notched locally, as shown at reference numerals 408, so that they can be bent during movement of the base portions from the solid line horizontal, as shown in FIG. 6, to the dotted line positions, as shown in FIG. 6. The notches 408 should be made deep enough to permit the runners or strips 404 to bend with the distrotion and yet not so deep as to weaken the structure unduly. The mattress 380 may be finished off by providing foam end strips 410 if desired. Any suitable mechanical mechanism for lifting or swinging the portions 396, 398, 400 and 402 from the horizontal to any of the various positions required may be used. Such mechanisms are well known in the art and need not be depicted here.

It is to be understood that a complete module such as module 330 comprising at least primary bearing surfaces 346 are provided on each well 362 of mattress 380.

In the mattresses shown in FIGS. 5 through 7 the displaceable surface 350 may have the sheet foam 348 as shown in FIG. 5, or the composite shown in FIG. 6, or any of the coverings illustrated in FIGS. 8 through 12 of U.S. Pat. No. 3,790,150, or described therein. The bearing surfaces 346 may also be left bare to provide a plane surface such as those shown at reference numerals 156 and 156*a* in FIGS. 5 and 6 of U.S. Pat. No. 3,790,150.

Figure 8:
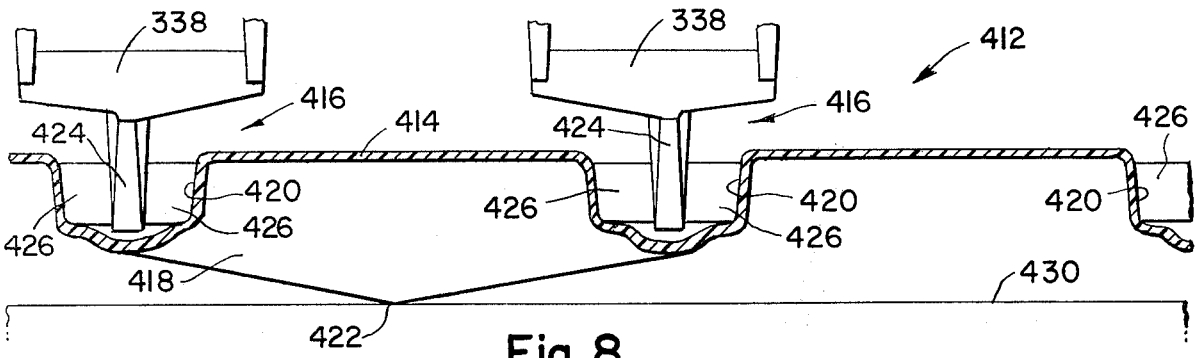
FIG. 8 is a sectional view taken through another form of mattress with parts cut away.
Figure 9:
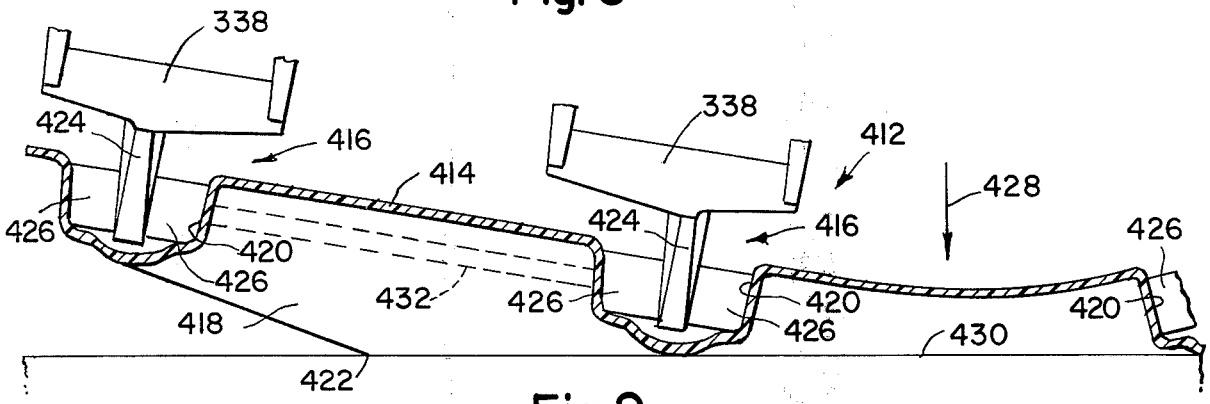
FIG. 9 is a sectional view similar to FIG. 8 showing the mattress in a different position under pressure.

The mattresses as described hereinabove can be made as a unitary pad comprising the mattress base 382, the module 330 and covering, in the same size and shape of a standard mattress and can be used as a substitute for a standard mattress on a standard bed frame including a standard gatching hospital bed. Another form of mattress 412 having a flexible preformed base 414 can be made as shown in FIGS. 8 and 9. In mattress 412 modules 416 are provided which are substantially similar to modules 330 except that the lowermost lever 332 is eliminated. In place of lowermost lever 332 the portion 418 of the preformed base 414 between module wells 420 is provided with a pivotal area 422, which serves a similar function to pivot 333 of lever 332 of module 330. Levers 424 of modules 416 would be substantially identical to levers 336 of modules 330 except that mounting lugs 426 would be provided on each side of lever 424 for mounting to the wells 420 of the mattress base 414. Reference to FIG. 8 will show such a formation in unloaded condition with a rocking or pivot point 422 in a balanced condition. Reference to FIG. 9 will show arrow 428 indicating a load on modules 416 nearest the load 428 causing the flexible base 418 to rock on rocking point 422 on the surface of bed frame 430 in much the same manner as lowest lever 332 of a module 330 would rock inside a well 362 under similar circumstances. Thus in a construction of a mattress 412, as shown in FIG. 8 and FIG. 9, two modules 416 in combination with preformed base section 418 are the substantial equivalent of one module 330 and will function in the same manner.

It is to be understood that the preformed base 414 of the mattress 412 must be made of a material strong enough to hold the modules 416 in place and yet have sufficient flexibility in and around the well 420 arrangement to permit the device to function as described.

Reference is again made to FIG. 9 of the drawings to the dotted lines indicated by reference numeral 432. This reference numeral indicates the possibility of molding two modules 416 together as a unit for economy purposes with the connecting arm 432 functioning primarily as a joint to hold the two modules together. A suitable recess can be made in the base 418 to accommodate this joining arm 432. Wells 420 may be provided with additional recesses to accommodate movement of the upper arms of the modules 416 if desired, and suitable covering and edging may be incorporated to finish the mattress 412.

Figure 17:
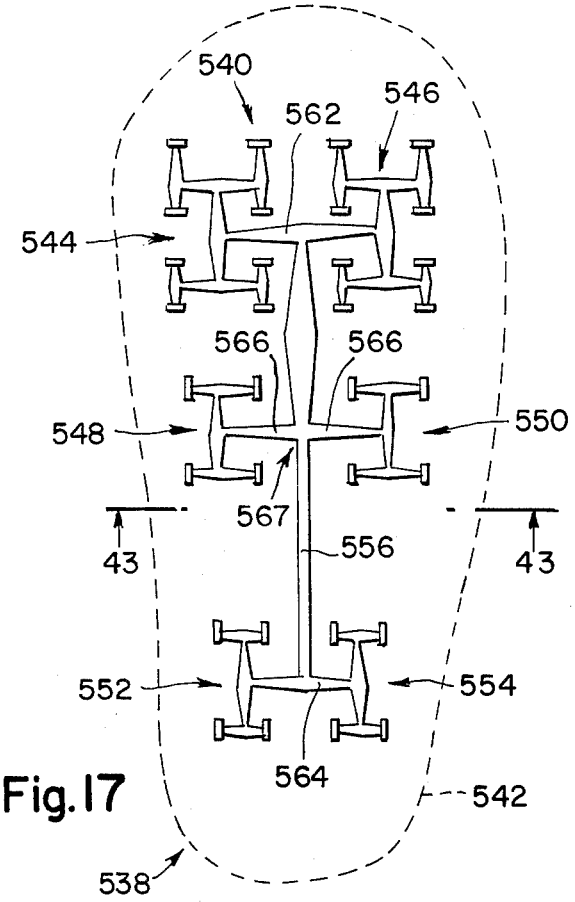
FIG. 17 is a top plan view of a show with parts in phantom.
Figure 18:
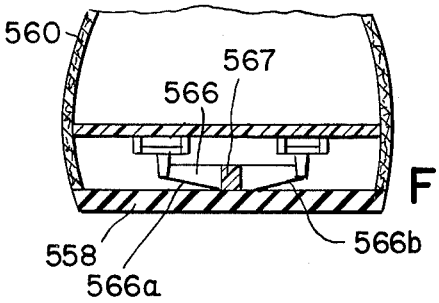
FIG. 18 is a section as seen from lines 18—18 in FIG. 17.
Figure 19:
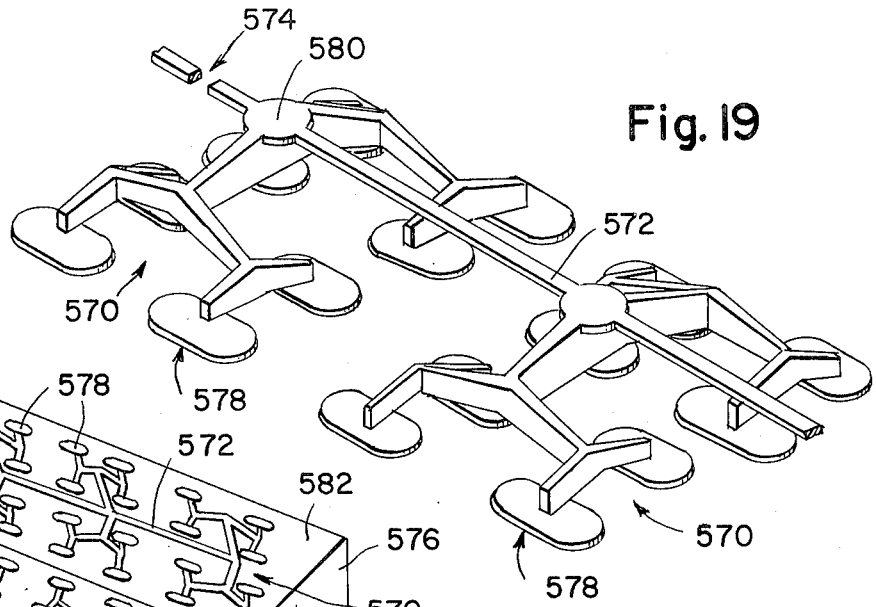
FIG. 19 is a perspective view.

FIGS. 17, 18 and 19 of U.S. Pat. No. 3,790,150 show a chair having a frame 264 and legs 266 and branched systems 260 and 262.

Figure 10:
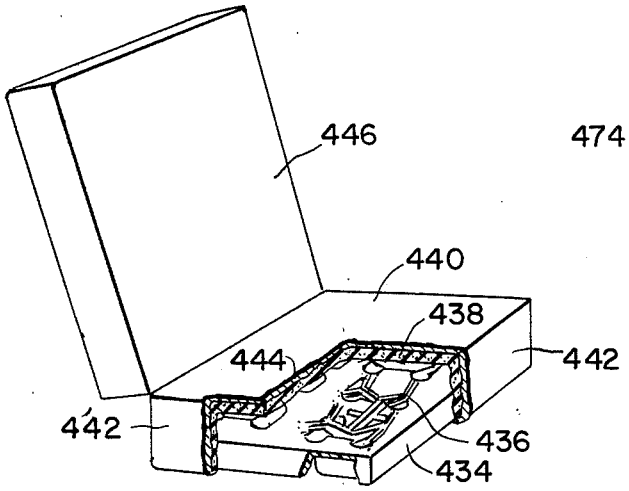
FIG. 10 is a perspective view with parts cut away.
Figure 12:
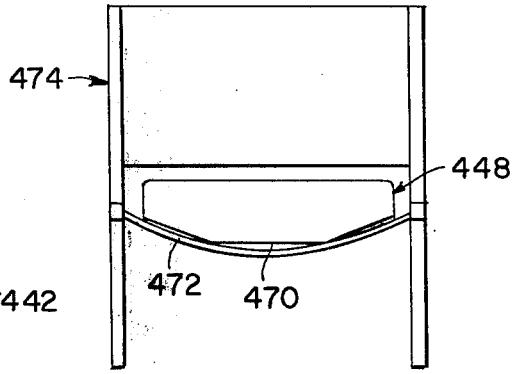
FIG. 12 is a front elevation.

In FIG. 10 of the drawings herewith another form of chair seat or sofa seat is shown together with a seat back. The seat or sofa seat 432, depending on its size, has a base 434 similar to base 360 (shown in FIG. 5) and modules 436 similar to modules 330 in type of construction. Overlying the modules 436 is a layer of foam 438 which provides a top 440 as well as sides 442 for the seat 432. A finishing fabric 444 may also be provided to cover the seat 432. In this seat construction as well as in any other cushioning construction of the invention the seat may be finished off in the same manner as the mattress described hereinabove.

The modules 436 may be exactly as modules 330 or they may be made of a material of different stiffness, eliminating the secondary and tertiary bearings, since a uniform cushioning may be effected through the action of the modules 436 combined with a foam layer 438 as shown, without the necessity of providing secondary or tertiary bearings. The seat back 446 is substantially similar to the seat 432 with the exception that its modules (not shown) may be made with softer material or levers having thinner sections as there will be less weight to bear.

Figure 11:
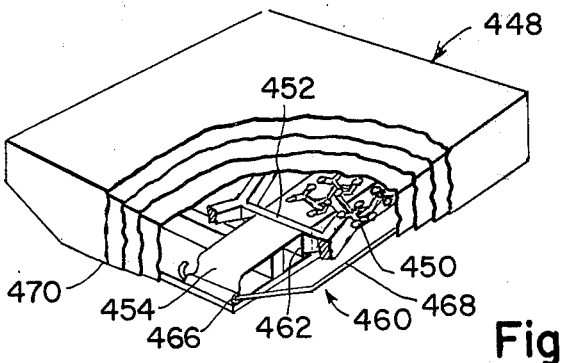
FIG. 11 is a perspective view with parts cut away.

In FIG. 11 of the drawings another form of seat cushion 448 is shown in which the modules 450 are provided with a lower base branch 452 adapted to fit on a metal strip 454 type of base 460 having bent receiving portions 462 for the lower branch 452.

The metal strips 454 on each side of the cushion 448 are provided with frame holding portions 466 into which wire frames 468 are seated. Wire frames 468 are formed to provide a lower rim 470 for the seat cushion 448 which is formed higher at the sides than at the front and back. The modules 450 fit because they are narrower at the bottom than at the top. The upward tapering of the sides of the frame which results can better be seen in FIG. 11 of the drawings wherein a seat cushion 448 has been placed on the canvas seat 472 of a folding chair 474. If a non-tapered cushion is placed on a canvas seat 472 it will have a tendency to raise the height of the seat much more than a tapered cushion. The tapered cushion 448 may be finished by covering with a sheet of material and a sheet of foam and an outer decorative cover as in the other cushions.

In FIG. 13 another constructional detail is shown for mounting modules of the invention to a base 480. In this case the base 480 is made of plywood or any other rigid type material and the modules 482, which are similar to modules 330, excepting that the lowermost branch 484 is provided with a mounting bracket 486 instead of the torsional mounting lugs 334. Mounting bracket 486 extends laterally and may be made of the same material as lever 484 and may be molded in one piece therewith. It is provided with a series of holes 488 through which screws, bolts or rivets 490 may be placed to connect the module 482 to the mounting board 480 through holes 492.

In the frame shown in FIG. 15 there is provision for mounting four modules 482 which will make a cushioning unit 494 suitable for use as an automobile seat or a section of any type of bench seating. The usual module for this purpose is approximately 9½ inches square and this will provide seating surface approximately 20 inches square which is suitable for seating one person. Several units 494 can be aligned side to side to provide for bench or sofa type seating in a vehicle or otherwise and backs for the seats may be made in the same way as the seat units 494.

In FIG. 14 another form of cushion frame 500 is shown in which one or more steel strips 502 are welded to a wire frame 504 which, in turn, is provided with cross wires 506. The cross wires 506 have torsional properties with relation to the rod or wire of the frame 504. A lower branch 508 of a module 510 similar to module 330 is molded around each cross wire 506. This provides a seating arrangement with a plurality of regularly spaced modules 510. The steel strips 502 may be provided with holes 512 to fix the frame construction 500 to a sub-base for mounting. The construction as shown in FIG. 14 may be used either as a seat or a back portion. It may also be used for affixation to a sub-base such as a wall, ceiling or floor or to any other type of construction to provide shock absorbing cushioning material. The cushioning construction may be finished off in any manner described herein.

Various other mounting constructions for mounting modules of the invention to bases for use in vehicles or stationary constructions are shown. For example, in FIGS. 15 and 16 a module 514 similar to module 482 (FIG. 13) is shown with a side bracket 516. The bracket 516 which may be molded integrally with the module 514 or may be made of metal and attached to the module may be fitted into a sleeve such as in the tube 518 in FIG. 13. Snap-in lugs 520 are then placed in holes 522 in the tube 518 and through holes 524 in side brackets 516 to fasten the modules 514 in place. Any number of tubes 518 may be placed on tube holding brackets 526 in any desired position to position a number of modules to provide a bearing surface as desired. The bracket 526 may be made of urethane or any other shock absorbing type of material.

In FIG. 16 a sub-plate 528 of stamped steel having fastening means such as a screw 530 to fasten it to a construction (as, for example, a vehicle frame) is provided with four corners 532 having a similar snap-in lug 520 construction to which four modules 514 can be attached in a manner similar to that shown in FIG. 15.

An automobile seat, or the like, made in accordance with any of FIGS. 9 through 16, may be covered with foam as set forth above. The edge of the foam sheet may be carried around and cemented underneath the base of the construction to have a curved edge similar to car seat upholstery presently in use or a more substantial foam edging may be used as in the mattress 380.

Because of the load distribution characteristics of the system of the invention, it is ideally suited to supporting the foot in shoes. Its conformability makes it possible to adapt readily to any normal foot and to many abnormal feet. While a shoe sole construction 538 as shown in FIGS. 17 and 18 is similar to that used in beds or seating, the pressures are considerably higher and the configuration different and the size considerably smaller.

A module system 540 together with a flexible sheet 542 constitute a portion of the shoe, such as the inner sole 538. System 540 would be made up of a number of modules 544 – 554 joined by at least one central runner 556 that would serve to permit the modules 544 – 554 to be molded as a unitary system 540. The unit 540, as shown in FIG. 17, would be bonded to a flexible sheet 542 that could be prepared and shaped or molded with thickness variations to provide uniform load distribution between supporting levers of the modules.

The lower portion of the module unit 540 may be affixed to an outer sole 558 which, in turn, can be sewn or fastened to shoe upper 560 in any manner known to the art. The lower portion of the unit 540 including the runners 556 and cross runners 562 and 564 may themselves be used as an outer sole eliminating an additional outer sole 558. In this case it might be desirable to thicken the bottom portions with extra material and also by providing extra corners between the cross runners 562 and 564 or in other areas, or by using steel or other hard material for the runners 556 and cross runners 562 and 564.

The dotted outline 542 in FIG. 17 represents a piece of leather, plastic or other material suitable for use as an inner sole of a shoe which would serve as support for the sole of the foot of the wearer. The inner sole portion 542 may be placed over and cemented to the modules of unit 540 as shown in FIG. 18.

Modules 544 and 546 are substantially similar to module 330, or 416, although reduced in size as necessary to fit in a shoe. They are placed on cross runner 562 to the left and right of a center line formed by runner 556.

Farther back and at an area designed to be beneath the arch of the wearer a second pair of modules 548 and 550 are mounted on a movable cross lever 566 which, in turn, is mounted at reference numeral 568 to runner 556. The mounting of lever 566 may have a rocking area at 567 similar to point 333 of module 330 so that modules 548 and 550 may have a relative and opposite up and down motion respective of each other. In the form shown in FIG. 18 the rocking at area 567 is accomplished by slanting the undersides **566*a* and 566*b* of runner lever 556 upwardly, as shown. Finally, there are a pair of modules 552 and 554 fixed side by side at the heel portion of the sole 538 to operate independently of each other in the same way as 544 and 546** at the toe portion operate.

The requirements in a construction 538 are different in different areas of the foot. At the ball and heel of the foot lateral stability is important. In these areas the modules are based independently to provide greatest stability providing two point support across the foot. In the arch area the base of the modules is lever 566 providing lateral conformability for the inclination variations between arches.

Thus modules 549 and 550 can be disposed relative to a load presented by a human arch which on the right foot would be higher on the left side than on the right side and on the left foot would be higher on the right side than on the left side. Only one shoe is shown in the illustration because the rocking feature of the arch modules 548 and 550 adapt the sole to be worn on either the left or right foot of the wearer. The lever arrangement might take many forms other than that shown and still function, and a unit 538 may have a preformed flexible base having wells similar to wells 362, proportioned to receive the module system 540.

The lower sole 558 can be a stiff material such as wood or even a metal having suitable portions known to the footwear art to aid the wearer in stepping from heel to toe in the usual walking exercise.

Stiffness of the module elements might vary to provide support where most needed. Those module elements under the heel would be stiffest because of the small area and the impact loads experienced in walking or running. The ball of the foot would require the medium level of stiffness and the arch would receive relatively light support. In this manner each portion of the foot could perform best its intended function. While not absolutely necessary, left and right foot soles 538 could also be designed in accordance with the invention.

The unit 538 described above is basically a cushioned pad for a shoe. Such cushioned pads may be finished off and employed for many needs less specialized. The module suspension structure may take the form of a rectangular pad or strip which may be laid in place or wrapped around something to be protected. Such a pad could be miniatureized modules linked together, and might be laid over the modules 330 or frames 360 in place of the foam sheet 348 show in FIG. 5. Such pads or cushions might replace pure foam sheeting or cushioning in some applications and find use where foam, while being too stiff for cushioning purposes, would nevertheless compress and deform enought to bottom under shock load. The pad structure of the invention including a module system can be made to conform readily to its load yet strongly resist further deformation.

This might render it a suitable pad for absorbing shock in dynamic situations involving vehicles or the use of sporting gear such as helmets and knee pads. Module pads might also be used for packaging delicate items or protecting injured or burned limbs while permitting air to circulate, supporting patients on a stretcher or operating table, or supporting people on seats that would be ventilated. Pads may be molded in sheets and joined for larger coverage or cut to shape for smaller or contoured areas. They may be from ⅛ to several inches thick and would consist of many modules with from two to six levels of levers molded together via runners to form a fabric.

Figure 20:
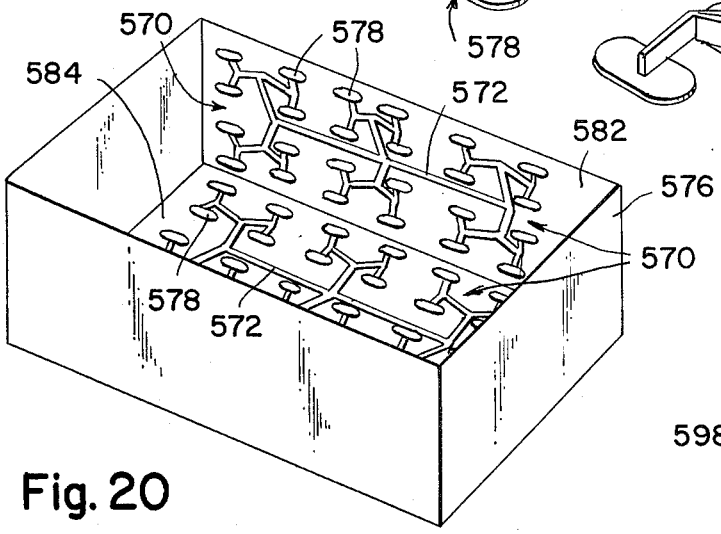
FIG. 20 is a perspective view.

Packaging and general cushioning materials are shown in FIGS. 19 and 20 of the drawings. In FIG. 44 modules 570 are mounted along a continuous strip 572. The strip could be cut at any desired point such as point 574 to provide a strip having any number of modules 570. In FIG. 20 the strip 572 has been cut into lengths having three modules 570 to fit within the dimensions of a box 576. Either the strip 572 (or the bearing surfaces 578) can be provided with a coating pressure sensitive adhesive 580 so that the strip 572 can be placed against a package wall 582 and held for packing purposes (or, if desired, the bearings 578 can be secured to the package wall 582). In any case, the packaged load or item to be placed within indicated at reference numeral 584 will be held inside the cushion formed by strips of modules 570. The load or item 584 is indicated by the arrow, but it can be anything which is subject to being packaged in a box or wrapped.

Figure 21:
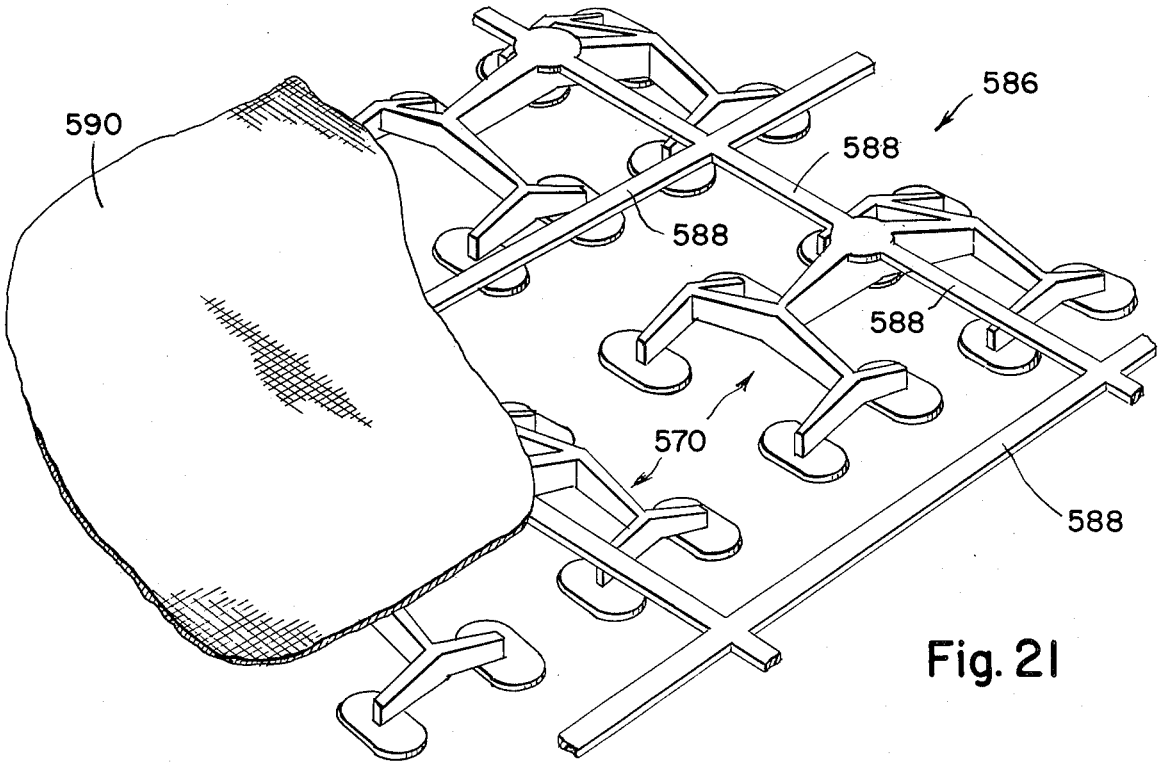
FIG. 21 is a perspective view.

In addition to providing continuous strips 572 formed with a single row of modules 570, a broader cushioning material 586 can be made up having grids 588 with modules 570 placed at regular or desired intervals (as in FIG. 21). Thus a cushioning material 586 having determinable length as well as determinable width can be made in large pieces which can be rolled and stored for future use. Such a roll could be unrolled much the same as fabric piece goods or rolls of wrapping paper and cut to a desired size for fixing into a package 576 or for wrapping around an item 584, or 592, directly without a box 576.

Another use for the strip 572 or the grid material 586 can be for safety cushioning purposes in a vehicle such as an automobile. Strips 572 or grid material 586 made of modules 570 can be cemented or otherwise adhered to door posts, dashboards, roofs, as well as floors or any other portions of the interiof of a vehicle such as an automobile, or elevator, or any other moving or stationary construction as a safety feature.

Figure 22:
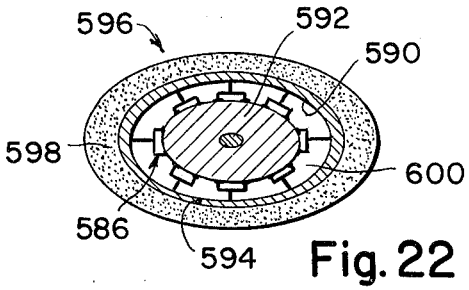
FIG. 22 is a sectional view.

Cushioning material 586 may be provided with a film or fabric backing 590, as shown in FIGS. 21 and 22, to adapt it to use in plaster cast applications which may be used to set broken bones, as well as for other purposes. The limb or body area over which it is desired to place a cast is measured. A quantity of material 586 with its backing 590 is cut to size and then placed around the limb or body portion 592 with the bearings 598 against the limb 592. If preferred, the fabric material 590 could be placed beneath the bearings 598 or two layers may be used above and below the grid material 586.

The entire construction is brought together at a point such as point 594 and the cast 596 finished by any means known to the art. For example, a layer of the usual plaster 598 used in making plaster casts can then be formed over the construction. Or, instead of plaster 598, a winding of adhesive tape or any other material which would form a rigid structure around the material 586 can be used. The advantage of this construction is that the spaces indicated at reference numeral 600 will permit air to come between the cast 596 and the limb 592 and may also permit the patient to be washed underneath the cast 596 in some applications. It is to be understood that the fabric 590 may be a porous fabric and the material out of which cushioning material 586 is made for this application could also be a material porous enough to permit air to seep through if desired.

A type of wheel is shown in U.S. Pat. No. 3,790,150 in FIGS. 20, 21 and 22 of the drawings. In addition to the wheel as shown therein, a tire can be made which can be used on an ordinary wheel or on the wheel of the invention as illustrated in said FIGS. 20 through 22.

Figure 23:
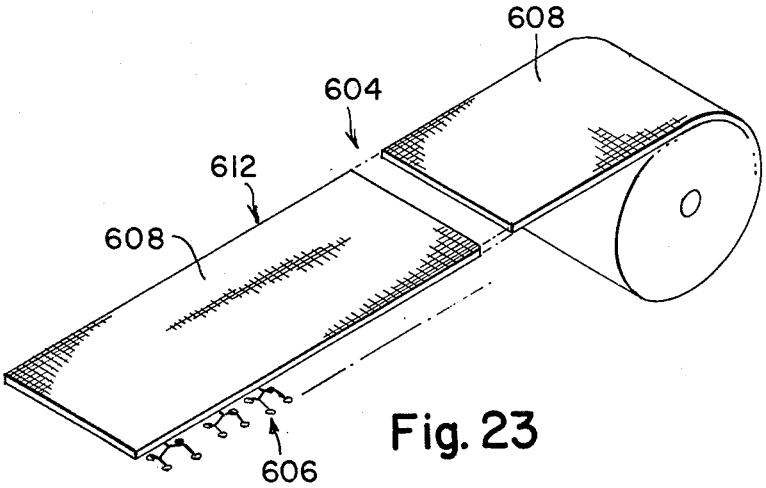
FIG. 23 is a perspective view.
Figure 25:
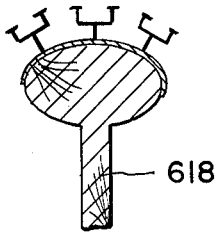
FIG. 25 and 26 are perspective views.
Figure 26:
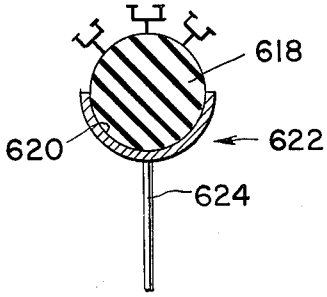

In FIG. 23 a long roll of cushioning material 604 with modules 606, made in accordance with the invention, is shown. Such a roll could be made with a base support such as backing material 608 and prepared in standard widths.

Figure 24:
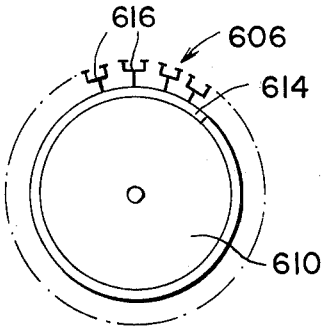
FIG. 24 is an end elevational view.

For example, let us say that a wheel 610 as shown in FIG. 24 would have a circumference of 36 inches and a tire width or tread of three inches. The roll of FIG. 23 could be made 3 inches wide and a 3 foot length 612 could be cut from it and placed around the wheel 610 with the modules 606 facing outwardly as shown in FIG. 24. The material 612 placed around the wheel 610 could be fastened by cementing or in any manner known to the art and would serve as a tire 614 around the circumference of the wheel 610. It is, therefore, apparent that many combinations of wheels and tires can be made in accordance with the invention in which displaceable bearing surfaces 616 of modules 606 would run along the ground providing a cushioning and shock absorbing effect to the wheel 610. Outer covering suitable for rough use against the ground could be provided in accordance with any of the forms of invention shown herein.

The modules 606, shown in FIGS. 23 – 26 are representative of modules of the invention which could be of any suitable size. The tread of the wheel 610 could be flat as shown in FIG. 24 or curved as shown in wheel 618 of FIG. 25, or the modules 606 could be placed on a preformed tire 618 as shown in cross section in FIG. 26 mounted on a U-shaped rim 620 of a wheel 622 with spokes 624.

Tire material could also be made out of strips 572, or grid material 586, by cutting a tire of the proper size and wrapping it around the wheel 610.

In special applications such as bicycle seats 630, as shown in FIGS. 27 through 29, the seating arrangement is in a saddle form which has a narrower front end 634, a wider rear end 636 and a pair of non-parallel converging sides 638. The module 644 of the invention is prepared in this form to provide the load support 640 of the contour for saddle type seating. Such seating may be used for bicycles, motorcycles, tractors and other vehicles, as well as stationary installations such as stools. These types of seats which may have a configuration substantially triangular, or even round, are usually supported by a single central support column 642.

The displaceable bearing means of a module 644, as well as the balanced levers, must necessarily be proportioned and balanced to provide a load support surface 640 for the purpose it is to have. Displaceable bearing means are therefore provided with varying bearing surfaces and levers which are proportioned to balance the bearing surface areas which they support. A preferred form of such a module 644 is shown in FIGS. 27 through 29. The area of the displaceable bearing means 650 at the wider end 636 is greater than the displaceable bearing means 652 at the narrower bearing end 634 and the levers are balanced accordingly. For example, the base or lowermost lever 654 is connected to a longer lever 656 at one end than at the other end which is connected to shorter lever 660. These levers 656 and 660 are respectively connected to levers 662 and 664 of different sizes and balances, and so on up through levers 666, 668, 670 and 672 and at the forward part of the seat 630 continuing further to levers 674 and 676 to complete the levers of the module.

The displaceable bearing means surface areas of bearing means 652 are the smallest. Bearing means 680 become larger, 682 larger still and 684 are larger than 682. Bearing means 686 are again larger and, finally, bearing means 650 have the largest area of all. There is also a pair of bearing means 652 which are smaller in area than bearing means 682 to which they are adjacent to finish the balance of the displaceable support surface 640.

The module 644 is illustrated in its preferred dimensions and it is therefore understood that such modules can be varied to suit seats or stools of different purposes. For example, the usual bicycle or motorcycle seat is illustrated in the figures in which there are two such modules 646 side by side attached to a base support means.

The module arrangement in a bicycle seat 630 provides a load support surface area 692 which comprises the combined load support surface areas 640 of the two modules 644 in the construction. The base support 690 is provided with a pair of sides 694 having laterally extending shelves 696 and openings 698 for fastening elements such as bolts or rivets 700 which, in the form of a bolt, may be fastened by nuts 702. Each module 644 is provided with attachment means such as plate 704 having an opening 706 through which the bolt or rivet 700 may pass and a pair of ears 708 to fit around the shelf 696.

The purpose of this construction is to provide for some stiffening of the springy material of the module 644. Thus, while it is intended that the module 644 should flex fowardly and rearwardly with relation to the base support 690, the inclusion of the plates 704 provides a certain amount of restraint to the flexion, and the ears 708 fit around shelf 696 which is abutted by the lower edge 710 of the plate 704. The base support means 640 also comprises one or more platforms 712 and 714. If the vehicle, such as the bicycle, should hit a bump and cause the levers to flex to a great extent, levers such as 662 and 666 which overlie platform 712 would actually hit the platform 712 if the force of the bump is great enough and the platform 712 would effectively stop any downward movement of the levers. Platform 714 would act in the same manner. The displaceable surface 692 is covered with a film or fabric 720 in the shape of a saddle or bicycle seat which may, in turn, be covered with an outer layer of foam 722. The outer foam layer 722 can also be covered with a finishing layer of leather, fabric or other material 724 as desired.

The base 690 has a mounting clamp arrangement including clamp means 730 and a bolt 732 fastened by a nut 734. The action of the clamp means 730 serves to attach the base support 690 to the upright 642 which forms a part of a structure of a vehicle, such as a bicycle (not shown). This type of clamp arrangement 730 permits adjustment of the seat on the upright or shaft 642.

While a preferred form of bicycle seat is shown, other similar seats for use in this type of vehicle having stationary constructions and seating arrangements having a single support such as a shaft 642 may be made in accordance with the invention.

While the invention has been described in its preferred forms there are other forms which it may take without departure from the spirit and scope of the invention and it is desired to be covered for all forms coming within the claims hereinbelow.

I claim:

1. A cushioning material construction comprising a mechanical support system comprising at least one module comprising a plurality of displaceable bearing means, particular ones of said bearing means being interconnected to others of said bearing means by a first lever-type arrangement, so as to define a grouping of bearing means, said first lever-type arrangement being operative upon displacement of one of said load support means in a first direction to apply a force to another of said bearing means in an opposite direction, such that the displaceable bearing means will displace to conform to the shape of an imposed load and provide for distribution of load supporting forces; wherein selected groupings of interconnected bearing means are further interconnected to other groupings of interconnected bearing means by means comprising a second lever-type arrangement in combination with main support means comprising at least one module holder for holding and positioning at least one module in a selected position with relation to the main support means.

2. The combination as claimed in claim 1, in which the main support means comprises at least one recess to accommodate at least a portion of at least one module.

3. The combination as claimed in claim 2, in which the main support means comprises a plurality of recesses each provided with means to receive at least one module.

4. The combination as claimed in claim 3, in which the recesses are in the form of H-shaped wells and the modules comprise at least one mounting lug complementary to at least one lug receiving journal comprised in an H-shaped well.

5. The combination as claimed in claim 4, in which there are a plurality of modules having their bearing means arranged to form a displaceable load support surface.

6. The combination as claimed in claim 5, in which the modules comprise secondary displaceable bearing means positioned beneath the unstressed surface of the load support surface formed by the first mentioned bearing means.

7. The combination as claimed in claim 6, in which the modules comprise tertiary displaceable bearing means positioned below the secondary bearing means.

8. The combination as claimed in claim 7, in which the lowermost module lever comprises a centrally located rocker means.

9. The combination as claimed in claim 8, in which a plurality of modules are mounted within a plurality of wells with the rocker means of the modules in contacting rocking relationship with the floors of the wells.

10. The combination as claimed in claim 5, in which the displaceable load support surface comprises at least one sheet of covering material.

11. The combination as claimed in claim 10, in which the displaceable load support surface comprises a layer of fabric laminated to a layer of foam.

12. The combination as claimed in claim 11, in which the layer of foam is a dual layer of foam of different stiffnesses.

13. The combination as claimed in claim 2, in which the module comprises a plurality of lever-type arrangements on different levels positioned to be accommodated in said recess and in which the greatest depth of the recess is shallower than the height of the module.

14. The combination as claimed in claim 13, in which the width of the recess in the main support means is less than the greatest width of at least one lever-type arrangement of the module.

15. The combination as claimed in claim 2, in which at least a portion of the main support means is flexible and comprises rocker means between at least one pair of recesses.

16. The combination as claimed in claim 4, in which the main support means is made up of a plurality of adjoining articulated sections.

17. The combination as claimed in claim 16, in which the articulated sections are joined together by at least one strip of flexible material.

18. The combination as claimed in claim 17, in which there are a plurality of strips comprising at least one notch means.

19. The combination as claimed in claim 1, in which the module holder is a clamping means.

20. The combination as claimed in claim 1, in which the module holder has a portion adapted to be fastened to the module by means of a rivet or bolt.

21. The combination as claimed in claim 1, in which the module holder is a means about which at least one portion of the module is molded.

22. The combination as claimed in claim 21, in which the module holder forms a section of the main support means.

23. The combination as claimed in claim 21, in which the module holder is an extension of the main support means.

24. The combination as claimed in claim 21, in which the main support means comprises a wire type frame and the module holder is a wire portion part of the frame.

25. The combination as claimed in claim 21, in which there are a plurality of module holders, each with a portion of at least one module molded around it and positioned so that the bearing surfaces of the modules form a displaceable support surface means.

26. The combination as claimed in claim 1, in which the main support means comprises a wire frame including at least one sheet formed element having bends to form at least one recess to form a module holder.

27. The combination as claimed in claim 26 which includes a plurality of recesses positioned to hold a plurality of modules so that their bearing elements will form a bearing surface area in a desired position.

28. The combination as claimed in claim 1, in which at least one module has a laterally extending bracket member adapted to be positioned into a bracket member holder comprised in the main support means.

29. The combination as claimed in claim 28, in which the bracket member holder comprised in the main support means is a tubular member.

30. The combination as claimed in claim 29, in which there are a plurality of tubular module bracket holder members positioned to support modules to form a supporting surface area comprised of the bearing surfaces of the said modules.

31. The combination as claimed in claim 1, in which the main support means comprises a flat sheet of material and at least one module comprises a laterally extending bracket adapted to be fastened to the flat sheet of material.

32. The combination as claimed in claim 1, in which the main support means is a plate having means for fastening said plate to a structure, said plate including at least one tubular formation for receiving a portion of at least one module.

33. The combination as claimed in claim 1, in which the main support means is a continuous strip of indeterminate length.

34. The combination as claimed in claim 33, in which the main support means has a series of levers of modules connected at regular intervals along its length.

35. The combination as claimed in claim 34, in which the modules are arranged to present a continuous bearing surface area comprising the bearing surfaces of the modules.

36. The combination as claimed in claim 1, in which the main support means comprises a grid structure.

37. The combination as claimed in claim 36, in which the grid structure of the main support means is connected at regular intervals to levers of modules.

38. The combination as claimed in claim 37, in which there is a layer of material combined with the grid structure.

39. The combination as claimed in claim 37 being made of a springy material.

40. A module for a cushioning material construction comprising a plurality of displaceable bearing means, particular ones of said bearing means being interconnected to others of said bearing means by a first lever-type arrangement, so as to define a grouping of bearing means, said first lever-type arrangement being operative upon displacement of one of said load support means in a first direction to apply a force to another of said bearing means in an opposite direction, such that the displaceable bearing means will displace to conform to the shape of an imposed load and provide for distribution of load supporting forces; wherein selected groupings of interconnected bearing means are further interconnected to other groupings of interconnected bearing means by a second lever-type arrangement further comprising secondary displaceable bearing means positioned below the first mentioned bearing means.

41. The module for a cushioning material construction as claimed in claim 40 which further comprises tertiary displaceable bearing means positioned beneath the secondary displaceable bearing means.

42. The module for a cushioning material construction as claimed in claim 40, in which at least one lever-type arrangement is provided with at least one mounting means.

43. The module for a cushioning material construction as claimed in claim 40, in which at least one lever comprises rocker means.

* * * * *